US005963709A

United States Patent [19]

Staples et al.

[11] Patent Number: 5,963,709

[45] Date of Patent: Oct. 5, 1999

[54] HOT AIR BLOWER HAVING TWO POROUS MATERIALS AND GAP THEREBETWEEN

[75] Inventors: Kandy Staples, Hamilton; Vijay Sarvepalli, Cincinnati; Ming Fu, Cincinnati; Jainagesh A. Sekhar, Cincinnati, all of Ohio

[73] Assignee: Micropyretics Heaters International, Inc., Cincinnati, Ohio

[21] Appl. No.: 08/855,424

[22] Filed: May 13, 1997

[51] Int. Cl.[6] ..... F24H 3/00

[52] U.S. Cl. ..... 392/488; 392/379

[58] Field of Search ..... 392/488, 485, 392/379, 383, 384, 385, 350, 396–398; 165/121, 122, DIG. 530; 261/DIG. 31, 142, 154; 55/308, 350.1, 442, 443, 482, 484, 485

[56] References Cited

U.S. PATENT DOCUMENTS

| | | | |
|---|---|---|---|
| 427,574 | 5/1890 | Howard | 392/350 |
| 2,837,623 | 6/1958 | Judson et al. | 392/466 |
| 3,104,307 | 9/1963 | Garofalow et al. | 392/485 |
| 3,688,083 | 8/1972 | Rice et al. | 392/488 |
| 3,934,117 | 1/1976 | Schladitz | 392/488 |
| 3,965,047 | 6/1976 | Yamaguchi | 428/457 |
| 5,117,482 | 5/1992 | Hauber | 392/485 |
| 5,465,573 | 11/1995 | Abe et al. | 392/490 |

FOREIGN PATENT DOCUMENTS

| | | | |
|---|---|---|---|
| 512667 | 1/1921 | France | 392/485 |
| 8027586 | 4/1981 | Germany | 392/383 |
| 299036 | 3/1971 | U.S.S.R. | 392/485 |

*Primary Examiner*—John A. Jeffery
*Attorney, Agent, or Firm*—Jayadeep R. Deshmukh

[57] ABSTRACT

A hot air blower is provided having a first material, a second material, and a gap disposed between the two materials. The gap provides residence time in order for a gaseous flow delivered through the blower to become heated. The materials preferably comprise porous ceramic foam and provide a tortuous path for the gaseous flow. The preferred ratio of the volume of the materials to the volume of the gap is 3. The blower also preferably comprises a heating element for imparting heat to the gaseous flow, and a fan for creating the flow.

22 Claims, 2 Drawing Sheets

HOT AIR BLOWER HAVING TWO POROUS MATERIALS AND GAP THEREBETWEEN

TECHNICAL FIELD OF THE INVENTION

This invention relates to the field of hot air blowers and, more particularly, to hot air blowers having a pair of porous materials and a gap therebetween such that air flowing through the blower is provided with residence time for absorbing heat.

BACKGROUND OF THE INVENTION

Today, hot air blowers are used for a variety of applications including direct heating of part surfaces, incineration of gas particulates, and heating enclosed chambers. More particularly, hot air blowers can be used for refractory curing, plastics sealing, cleaning diesel exhaust, and retrofitting gas fired ovens and furnaces.

Such blowers typically comprise a blower fan, an electric heating element, and a housing for the heating element. The blower fan forces air into the housing through an inlet at one end of the blower. The air is then heated by convection and radiation as it passes near the heating element and is provided at the outlet at the opposite end of the blower.

Blowers designed with metallic heating elements have until now generated air temperatures up to 1,472° F. (800° C.). If a blower is made with molybdenum disilicide heating elements it is anticipated that such a blower can heat air higher than 1,832° F. (1,000° C.). While technical advances have allowed blowers to produce higher temperatures, there is a continual quest to produce even higher temperatures so that the range of applications of such blowers can be expanded. Furthermore, it is desirable to construct a blower having a maximum percentage of energy transfer efficiency, i.e. that transfers the maximum amount of electrical energy to heat energy thereby reducing the cost to operate the blower. In addition to limitations in temperature output and energy efficiency, current blowers suffer from other limitations as well. For example, it has been found that blowers with metallic heating elements are limited in their maximum temperature output because, in part, the heating element will crack if it becomes too hot relative to the air that passes near it.

Accordingly, it is desirable to construct a hot air blower that can produce higher temperatures than current hot air blowers. Furthermore, it is desirable to produce a hot air blower that has a higher energy efficiency than current blowers. Moreover, it is desirable to produce a hot air blower that does not cause the metallic heating element used within it to crack when the element reaches a certain temperature relative to the air passing near it.

Several advances have been made in the field of porous ceramic materials. For example, U.S. Pat. No. 5,279,737 (the '737 patent) and U.S. Pat. No. 5,558,760 (the '760 patent) disclose the use of porous ceramic materials as regenerative filters to clean exhaust emitted from engine-run vehicles such as buses. These references disclose methods for the production of such materials, which methods will be described in greater detail below. In addition, the '760 patent discloses the manufacture of a porous body that is conductive such that it can simultaneously act as a heating element as well as a filter, thereby eliminating the need for a heating element in the regenerative filter and decreasing the amount of heat lost due to radiation. While the references disclose the use of porous ceramic materials as regenerative filters, neither of these references disclose or suggest the use of a pair of such porous ceramic materials within a hot air blower. Nor do these references disclose or suggest the use of such materials for creating an air gap within a hot air blower, thereby increasing the temperature of the output air as well as the blower efficiency.

SUMMARY OF THE INVENTION

It is an object of this invention to provide a device and method for heating a gaseous flow that can impart high temperatures to the flow.

It is another object of the present invention to provide a device and method for heating a gaseous flow that has high energy transfer efficiency.

It is yet another object of this invention to provide a device and method for heating a gaseous flow that can be used with a metallic or ceramic (such as molybdenum disilicide, silicon carbide, zirconia, carbon or boron nitride) heating elements at high temperatures without causing the element to crack.

A further object of this invention is to provide a device and method for heating a gaseous flow that provides an ideal residence time for the flow.

Another object of this invention is to provide a device and method for heating a gaseous flow that utilizes a pair of porous materials to provide a tortuous path for the flow and an increased residence time for heating the flow.

To achieve the foregoing and other objects and in accordance with the purposes of the present invention as described above, a device for heating a gaseous flow is provided having a first material, a second material, and a heat source. The first material has an inlet side for receiving the gaseous flow, an inner side for discharging the gaseous flow, and a plurality of openings, the openings providing at least one passageway from the inlet side to the inner side. The first material preferably comprises a porous ceramic material. The second material has an inner side for receiving the gaseous flow, an outlet side for discharging the gaseous flow, and a plurality of openings, the openings providing at least one passageway from the inner side to the outlet side. The inner side of the first material and the inner side of the second material define a gap for providing residence time for gases passing therethrough. Preferably, the second material comprises a porous ceramic material. It is also preferred that the ratio of the volume of the materials to the volume of the gap is 3. The heat source is in direct or indirect contact with the gaseous flow and provides heat thereto. Preferably, the heat source is an electric heating element.

A method of heating a gaseous flow is also provided comprising the steps of providing a first material, a second material, and a gap therebetween, and forcing a gaseous flow through the first material, the gap, and the second material. The first material and the second material are preferably comprise a porous ceramic material. It is also preferred that the ratio of the volume of the materials to the volume of the gap is 3.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF THE INVENTION

Figure 1:
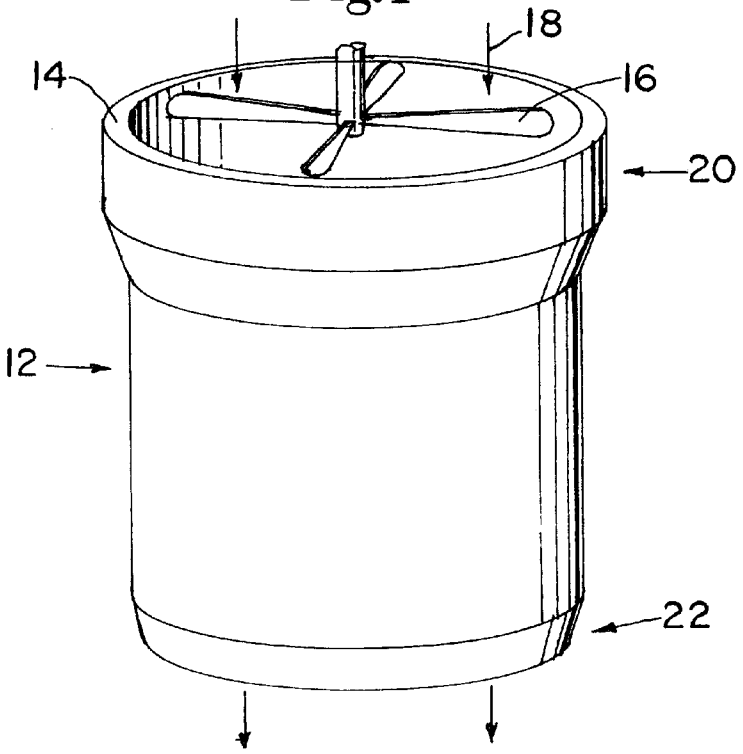
FIG. 1 is a side perspective view of the hot air blower of the present invention.

Referring now to the drawings in detail, wherein like numerals indicate the same elements throughout the views, FIG. 1 is a side perspective view of a preferred embodiment of the present invention. As shown in FIG. 1, hot air blower 12 has a housing comprising a stainless steel shell 14 configured in a substantially cylindrical shape. The blower 12 has an inlet end 20 and an outlet end 22. A fan 16 is disposed near the inlet end 20 for receiving a gaseous flow, depicted by the arrows 18, so that the gaseous flow can be directed through the blower 12 from its inlet end 20 toward its outlet end 22. Fan 18 is preferably driven by an electric motor (not shown).

The gaseous flow 18 to be heated by the blower 12 can comprise a variety of gases or combinations of gases, preferably so that the gases are not chemically reactive when heated to a temperature at which the blower will operate. For example, the gaseous flow 18 can be air that is to be heated and applied to a part or chamber. Also, the gaseous flow can be engine exhaust having particulates that are to be incinerated by the heat of the blower 12. Moreover, although the blower 12 is depicted in its vertical position in FIG. 1, it may be operated in a horizontal manner or at any angle to horizontal.

Figure 2:
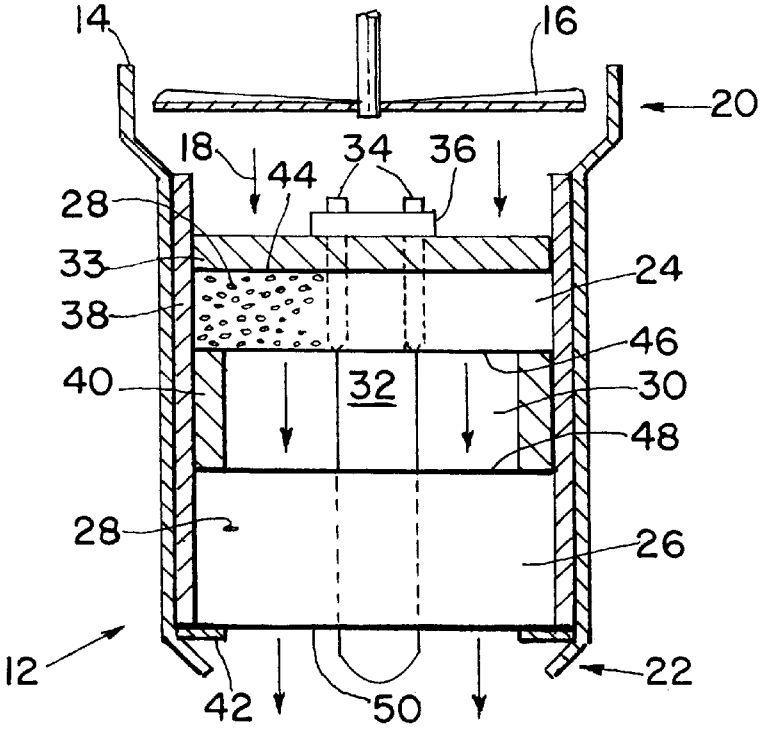
FIG. 2 is a cross-sectional view of the hot air blower of FIG. 1.

FIG. 2 is a cross sectional view of the preferred embodiment of FIG. 1. As shown in FIG. 2, the blower preferably has an insulating liner 38 adjacent the interior surfaces of shell 14 for preventing loss of heat from the interior of the blower. Insulating liner 38 can comprise any insulating material that is physically and chemically stable at the temperature at which the blower is to operate, such as alumina silica fibers, micro quartz fiber and the like.

As is also shown by FIG. 2, the representative embodiment further includes a first material 24 and a second material 26 disposed within the shell 14. The first material 24 includes an inlet side 44 for receiving a gaseous flow (depicted by arrows 18), from the fan 16 and an inner side 46 for discharging the gaseous flow. The second material 26 includes an inner side 48 for receiving the gaseous flow discharged by the first material 24, and an outlet side 50 for discharging this gaseous flow. Preferably, the outer edges of the first and second materials 24 and 26 directly abut the interior surface of the liner 38 such that there is no gap between the liner and the sides of the materials. It is also preferred that the materials 24 and 26 are spaced apart along the longitudinal axis of the blower 12 such that a gap 30 is formed between the two. Spacer 40 can be utilized to maintain the gap 30 between the inner sides 46 and 48 of the first and second materials 24 and 26. The spacer 40 is preferably comprised of an alumina silica cylindrical refractory. Ledge 42 may be utilized to help maintain the materials 24 and 26 at a desired location within the shell 14; the second material 26 can be placed upon the ledge, the spacer 40 may be placed upon the second material, and the first material 24 may be placed upon the spacer. Alternatively, the materials 24 and 26 can be secured to the shell using any manner known in the art such as by bolting, clamping, or the use of high temperature adhesives.

The first material 24 contains a plurality of pores 28 (shown schematically in FIG. 2) that provide at least one passageway for a gaseous flow to travel from the inlet side 44 to the inner side 46. Similarly, the second material 26 also contains a plurality of pores 28 that provide at least one passageway from the inner side 48 to the outlet side 50 of the material. Preferably, the pores 28 within the first material 24 are interconnected so as to provide a plurality of passageways through the material. Similarly, it is preferred that the pores 28 within the second material 26 are interconnected.

Preferably, the first and second materials 24 and 26 comprise a thermally shock resistant refractory. Even more preferably, the materials comprise porous ceramic foams. As is known in the art, such materials have a plurality of pores disposed throughout the material, the pores being well-suited for providing a tortuous path for gases flowing therethrough. Such a tortuous path causes the gas to rise in temperature and helps to prevent gas from escaping the material in a direction opposite the intended flow. Heating elements can be advantageously situated within the porous materials. Such a foam may then be utilized in the hot air blower 12 of FIGS. 1 and 2. It is most preferred that the first and second materials 24 and 26 comprise a porous sodium silicate cement having a colloidal alumina coating.

U.S. Pat. No. 5,558,760 discloses a method for manufacturing a porous ceramic material suitable for use as the first material 24 or second material 26. The resulting ceramic or ceramic composite structure/coating would be selected from the group consisting of borides of titanium, zirconium, niobium, tantalum, molybdenum, hafnium, chromium, and vanadium; aluminides (except of aluminum) carbides and oxides of titanium, hafnium, boron, aluminum, tantalum, silicon, tungsten, zirconium, niobium, iron, molybdenum, vanadium and chromium; carbonitrides of titanium, niobium and tantalum; nitrides of titanium, zirconium, boron, aluminum, silicon, tantalum, hafnium, and niobium; silicides of molybdenum, titanium, zirconium, niobium, tantalum, tungsten and vanadium; hydrides of titanium, zirconium and niobium; aluminum oxide-titanium boride; titanium carbide-titanium boride; aluminum oxide-titanium boride-titanium nitride; aluminum oxide-titanium boride-titanium carbide; boron carbide-aluminum oxide; molybdenum silicide-aluminum oxide; molybdenum boride-aluminum oxide; chromium carbide-aluminum oxide; vanadium nitride-aluminum oxide and mixtures thereof.

Figure 3:
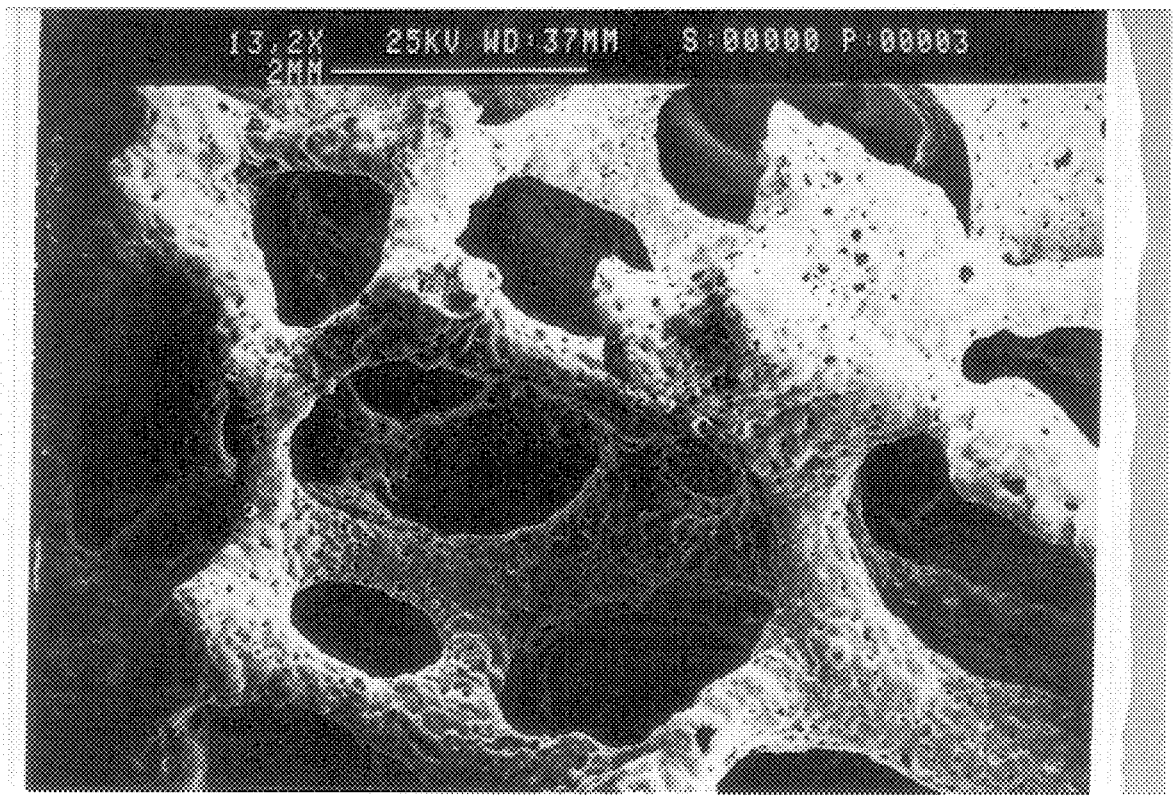
FIG. 3 is a micrograph of an $Al_2O_3$—SiC porous ceramic material suitable for use with the hot air blower of FIG. 1.

FIG. 3 is a micrograph showing an $Al_2O_3$—SiC ceramic foam that can be manufactured using the method of the '760 patent. As can be seen from the micrograph of FIG. 3, the ceramic foam has a multiplicity of interconnected pores. As noted above, these pores provide a tortuous path for gases flowing therethrough. Because of the tortuous path, the gases become heated as they pass through the foam. As noted in the '760 patent, the slurry used to create the foam can contain a metal that gives the foam a conductive property. Alternatively the foam can be coated with a conductive material. Such a foam can be used as for the first material 24 or the second material 26 of FIG. 2 and, thus, the materials can act as a heating elements in addition to the other functions they provide in the present invention. The entire specification of the '760 patent is incorporated herein by reference.

Although it is preferred that ceramic foam materials are used for the first and second materials 24 and 26, other porous materials might also be suitable, depending upon the temperature of operation. For example, materials such as lava rock and the like may be used. Moreover, ceramic foams in combination with other porous materials might also be used.

Returning again to FIG. 2, the preferred embodiment also contains a source of heat for heating the gaseous flow that travels through the blower 12. The heat source is shown in FIG. 2 as a U-shaped electric heating element 32. Heating element 32 preferably extends from the inner side 46 of the first material 24, through the gap 30 and through both sides 48 and 50 of the second material 26. In the embodiment, the heating element 32 is connected to electric terminals 34 that extend through the first material 24 and through a refractory slab 33 that is disposed adjacent the inlet side 44 of the first material 24. Preferably, the terminals 34 are connected to a ceramic holder 36 which is bolted to the slab 33. The slab 33 has a plurality of openings so that the gaseous flow may reach the inlet side 44 of the first material 24. Terminals 34 are connected to an electric power source (not shown) for delivering a current through the element 32.

The element 32 should be made of a resistive material such that it becomes heated as an electric current passes therethrough as is well known in the art. The element 32 can comprise any number of resistive materials suitable for obtaining a high temperature when an electric current passes therethrough. For example, the element 32 can comprise a metallic material such as nickel aluminide, molybdenum disilicide, nickel chromium alloy, and the like. Conventional U-shaped elements based on molybdenum disilicide, silicon carbide, zirconia, carbon or boron nitride can be heated up to a 1900° C. element temperature. While the heating element 32 is shown as U-shaped in FIG. 2, it is to be understood that the heating element 32 can comprise any number of shapes and types as are well known in the art. For example, the heating element 32 can have a multiple number of connected U-shaped members or can be provided in a spiral shape.

As an alternative to an electric heating element, other heat sources may be utilized to heat gases flowing through the blower. For example, the gaseous flow can be heated by a gas burner such as the burners used in gas furnaces and ovens. Furthermore, the heat source could be located in several possible locations including the gap 30, the first material 24, and/or the second material 26.

Furthermore, it is contemplated that hot air could be drawn directly out of the gap 30 as it is simultaneously drawn from the outlet end 22 of the blower 12. Moreover, additional fans may be utilized to aid in drawing the air from the blower 12. It is also contemplated that fins or baffles be utilized within the gap 30 to aid in increasing residence time and raising the temperature of the air output from the fan.

In operation, the blower forces air (or other gas, if desired) into the inlet 20. When the air reaches the first material 24, it travels from the inlet side 44, through the pores 28, and out the outlet side 46. As noted above, the pores 28 preferably provide a plurality of passageways through which the air may travel. It is even more preferred that the passageways have several turns and twists so that the air travels a "tortuous" path, as is known in the art. As also noted above, the pores 28 within the material 24 are preferably interconnected so that each pore is connected to a plurality of passageways extending from the inlet side 44 to the inner side 46. The first material 24 has a preferred porosity of 10 pores per inch, each pore having a diameter of about 0.01 inches.

The tortuous path provided by the pores 28 serves at least two functions. First, as air travels the tortuous path, it absorbs the heat retained by the first material and received from the heating element 32. This preheating of the air helps to prevent the heating element 32 from cracking, as metallic elements have been known to do when they come in contact with air that is too cool relative to the temperature of the element. The amount of preheating that occurs depends upon the thickness of the material, the porosity of the material, and the size of the pores. The greater the thickness and porosity, the more tortuous the path; the larger the pore size, the less tortuous the path.

The second function of the tortuous path is to help to prevent air from escaping the blower 12 in the opposite direction of the intended flow. Thus, although air that becomes heated will have a tendency to rise from the inner side 46 to the inlet side 44 when the blower 12 is used in the vertical position of FIG. 2, the air will have difficulty doing so due to the complex and turbulent flow experienced within the gap upon exiting the material 24.

Once the air is discharged from the inner side 46, it enters the gap 30 defined by the first material 24, the second material 26 and the interior wall of the spacer 40. The gap 30 can also be described as a cavity, space, or chamber. When air travels through the gap 30, it receives heat from the element 32 by convection and radiation. The gap 30 provides residence time for the air traveling from inner side 46 of the first material 24 to the inner side 48 of the second material 26 to become heated by the element 32. It is also believed that a complex combination of turbulent flow, convective flow, and recirculation zones occurring within the gap 30 contribute to the heat imparted to the gas therein. Thus, when the air reaches the inner side 48 of the second material 26, it has a higher temperature than when it first entered the gap 30 through the inner side 46 of the first material 24.

Like the first material 24, the second material 26 also has a number of pores 28 which are preferably interconnected so as to provide a tortuous path from the inner side 48 to the outlet side 50 of the material. It is also preferred that the second material 26 have the same porosity as the first material 24. As in the first material 24, the pores 28 of the second material 26 provide a tortuous path for air traveling through the second material and cause the air to rise even higher in temperature as it travels through the material. As shown in FIG. 2, the element 32, in addition to being disposed within the gap 30, is preferably also disposed within the second material 26 so as to provide additional heating of the air. The air is finally discharged through the outlet side 50 of the second material 26 and out the outlet end 22 of the blower 12 where it can be utilized by the user. Due to the tortuous paths provided by the materials 24 and 26, the residence time provided by gap 30, and the heat provided by the heating element 32, the air exiting the blower at the outlet end 22 is at a higher temperature than air brought into the blower through the inlet end 20.

It has been found that by providing materials 24 and 26 and air gap 30, the blower 12 can provide a greater hot air temperature than if neither material was present or if only one material and no gap were present. It has also been found that particular ratios of the volume of the materials 24 and 26 to the volume of the gap 30 provide higher temperature increases than other ratios. ("volume of the materials 24 and 26" means the sum of the volume of material 24 and the volume of material 26.) More particularly, it is preferred that the ratio of the volume of the materials 24 and 26 to the volume of the gap 30 be between about 1 and about 5. It is even more preferred that this ratio be between about 2.5 and about 3.5, and it is most preferred that the ratio be about 3.0. It is believed that this ratio provides ideal residence time for air within gap 30 to absorb heat from the element 32.

Moreover, it is believed that if the width of the gap 30 (the distance from the inner side 46 to the inner side 48) is too small, not enough residence time is provided for the air to absorb heat. Conversely, it is believed that if the width of the gap 30 is too large, air in the gap begins to rise and is not properly discharged from the blower 12, causing cooler air to be discharged instead. Accordingly, it is preferred that the ratio of the sum of the average thicknesses of the materials 24 and 26 to the average thickness of the gap 30 be between about 1 and about 5; it is more preferred that this ratio be between about 2.5 and about 3.5 and it is most preferred that this ratio be about 3.0. Average thickness, as used herein, means the sum of the thicknesses measured at x discrete points, divided by x. In a preferred embodiment, the first material 24 has a uniform thickness of 1.5 inches from the inlet side 44 to the inner side 46, the second material 26 has a uniform thickness of 3.0 inches from the inner side 48 to the outlet side 50, and the gap 30 has a uniform thickness of 1.5 inches.

The invention is illustrated by the following example,

EXAMPLE

A hot air blower was provided having a hollow stainless steel housing. The housing was open on its two ends so as to provide an inlet and outlet for air flowing therethrough. The housing was fitted with a fan at its inlet to provide a flow of air through the housing. Three pieces of porous sodium silicate cement having a porosity of 10 pores per inch were positioned within the shell between two fixed planes generally perpendicular to the interior shell walls. The first plane was located near the inlet end of the housing and the second plane was located near the outlet end of the housing. Each piece fit snugly within the shell such that there was little or no gap between the piece and the interior walls of the shell. Also, the pieces were disposed such that the first piece of ceramic foam directly abutted the first plane, the second piece of ceramic foam directly abutted the second plane, and the third piece of foam directly abutted the second piece. One air gap was provided between the third piece of foam and the first piece of foam. A metallic heating element was disposed within the blower; the element extended through the air gap and through the second and third pieces of foam. The terminals of the element extended through the first piece of foam and toward the inlet and were electrically connected to a power source.

Tests were performed to measure the temperature of the air output from the blower. For each test, the power provided by the heating element was held constant at about 4.8 kW, the volumetric flow rate provided through the blower was held constant at about 4.5 CFM, and the total volume inside the shell between the two fixed planes was held constant at about 169.6 cubic inches. For each test, the ratio of the total volume of the ceramic foam pieces to the volume of the air gap was varied by varying the widths of one or more of the pieces. For each test, the temperature of the air provided at the outlet of the blower was measured and the following data obtained:

| Foam Volume/Air Gap Volume | Temperature degrees centigrade |
|---|---|
| 1:1 | 715 |
| 2:1 | 749 |
| 3:1 | 839 |
| 10:1 | 470 |

As can be seen by the data obtained, the maximum temperature provided at the outlet of the blower was obtained when the ratio of the foam volume to the air gap volume was about 3.0 (the volume of each of the three pieces of ceramic foam was about 42.4 cubic inches and the volume of the gap was about 42.4 cubic inches). As noted above, it is believed that this occurred because this ratio provides the ideal residence time for the air flowing through the blower to absorb the heat provided by the heating element.

Having shown and described the preferred embodiments of the present invention, further adaptions of the device for heating a gaseous flow described herein can be accomplished by appropriate modifications by one of ordinary skill in the art without departing from the scope of the present invention. A number of alternatives and modifications have been described herein, and others will be apparent to those skilled in the art. Accordingly, the scope of the present invention should be considered in terms of the following claims, and is understood not to be limited to the details of the structures and methods shown and described in the specification and drawings.

What is claimed is:

1. A device for heating a gaseous flow comprising:

a first material having an inlet side for receiving a gaseous flow, an inner side for discharging said gaseous flow, and a plurality of openings, said openings providing at least one passageway from said inlet side to said inner side;

a second material having an inner side for receiving said gaseous flow, an outlet side for discharging said gaseous flow, and a plurality of openings, said openings providing at least one passageway from said inner side to said outlet side, wherein said inner side of said first material and said inner side of said second material define a gap therebetween, wherein the the ratio of the sum of the volumes of the first and second materials to the volume of the gap is between about 1 and about 5; and a heat source in heat transfer relation with said gaseous flow for heating said gaseous flow.

2. The device as recited in claim 1 wherein said heat source is disposed at least partially within said device for heating said gaseous flow.

3. The device as recited in claim 1 wherein said plurality of openings of said first material is a plurality of pores, and wherein said plurality of openings of said second material is a plurality of pores.

4. The device as recited in claim 3 wherein said plurality of pores of said first material are interconnected, and wherein said plurality of pores of said second material are interconnected.

5. The device as recited in claim 1 further comprising:

a fan in fluid communication with said inlet side of said first material, said fan being operative for creating said gaseous flow between said first inlet side, and said outlet side.

6. The device as recited in claim 5 further comprising an insulating material substantially contiguous with said inlet side of said first material.

7. The device as recited in claim 1 wherein said first material and said second material comprise a porous ceramic material.

8. The device as recited in claim 7 wherein said porous ceramic material is selected from the group consisting of borides of titanium, zirconium, niobium, tantalum, molybdenum, hafnium, chromium, and vanadium; aluminides (except of aluminum) carbides and oxides of titanium, hafnium, boron, aluminum, tantalum, silicon, tungsten, zirconium, niobium, iron, molybdenum, vanadium and chromium; carbonitrides of titanium, niobium and tantalum; nitrides of titanium, zirconium, boron, aluminum, silicon, tantalum, hafnium, and niobium; silicides of molybdenum, titanium, zirconium, niobium, tantalum, tungsten and vanadium; hydrides of titanium, zirconium and niobium; aluminum oxide-titanium boride; titanium carbide-titanium boride; aluminum oxide-titanium boride-titanium nitride; aluminum oxide-titanium boride-titanium carbide; boron carbide-aluminum oxide; molybdenum silicide-aluminum oxide; molybdenum boride-aluminum oxide; chromium carbide-aluminum oxide; vanadium nitride-aluminum oxide and mixtures thereof.

9. The device as recited in claim 1 wherein said first material and said second material comprise a porous sodium silicate cement having a colloidal alumina coating.

10. The device as recited in claim 1 wherein the ratio of the sum of the volumes of the first and second materials to the volume of the gap is between about 2.5 and about 3.5.

11. The device as recited in claim 1 wherein the ratio of the sum of the volumes of the first and second materials to the volume of the gap is between about 2.9 and about 3.0.

12. The device as recited in claim 1 wherein the heat source is a heating element.

13. The device as recited in claim 12 wherein the heating element extends from the inner side of the first material through the outlet side of the second material.

14. The device as recited in claim 1 wherein the first material is conductive and wherein the heat source comprises the first material.

15. The device as recited in claim 14 wherein the second material is conductive and wherein the heat source further comprises the second material.

16. A method of heating a gaseous flow comprising the steps of:

providing a first material having an inlet side, an inner side, and a plurality of openings, said openings providing at least one passageway from said inlet side to said inner side;

providing a second material having an inner side, an outlet side, and a plurality of openings, said openings providing at least one passageway from said inner side to said outlet side, wherein said inner side of said first material and said inner side of said second material define a gap therebetween, wherein the ratio of the sum of the volumes of the first and second materials to the volume of the gap is between about 1 and about 5; and forcing gas through said first material, said gap, and said second material.

17. The method as recited in claim 16 further comprising the step of:

providing a heat source in heat transfer relation with said gaseous flow.

18. The method of claim 16 wherein the first material and the second material are provided and configured such that the ratio of the sum of the average thicknesses of the first and second materials to the average thickness of the gap is between about 2.5 and about 3.5.

19. The method as recited in claim 16 wherein said gas is forced by use of a fan.

20. A device for heating a gaseous flow comprising:

a first material having an inlet side for receiving a gaseous flow, an inner side for discharging said gaseous flow, and a plurality of openings, said openings providing at least one passageway from said inlet side to said inner side;

a second material having an inner side for receiving said gaseous flow, an outlet side for discharging said gaseous flow, and a plurality of openings, said openings providing at least one passageway from said inner side to said outlet side, wherein said inner side of said first material and said inner side of said second material define a gap therebetween for providing residence time for gases passing therethrough, wherein the ratio of the sum of the average thickness of the first and second materials to the average thickness of the gap is between about 1 and 5; and a heat source in heat transfer relation with said gaseous flow for heating said gaseous flow.

21. The device as recited in claim 20 wherein the ratio of the sum of the average thicknesses of the first and second materials to the average thickness of the gap is about 3.

22. A device for heating a gaseous flow comprising:

a first porous ceramic material having an inlet side for receiving a gaseous flow, an inner side for discharging said gaseous flow, and a plurality of openings, said openings providing at least one passageway from said inlet side to said inner side;

a second porous ceramic material having an inner side for receiving said gaseous flow, an outlet side for discharging said gaseous flow, and a plurality of openings, said openings providing at least one passageway from said inner side to said outlet side, wherein said inner side of said first material and said inner side of said second material define a gap therebetween for providing residence time for gases passing therethrough, wherein the ratio of the sum of the volumes of the first and second materials to the volume of the gap is between about 1 and about 5; and a heat source in heat transfer relation with said gaseous flow for heating said gaseous flow.

* * * * *